US009902150B2

(12) United States Patent
Matsumoto et al.

(10) Patent No.: US 9,902,150 B2
(45) Date of Patent: Feb. 27, 2018

(54) LIQUID EJECTING HEAD, AND MANUFACTURING METHOD OF LIQUID EJECTING HEAD

(71) Applicant: SEIKO EPSON CORPORATION, Tokyo (JP)

(72) Inventors: Yasuyuki Matsumoto, Azumino (JP); Shuichi Tanaka, Chino (JP); Tsuyoshi Yoda, Matsumoto (JP); Naohiro Nakagawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/295,773

(22) Filed: Oct. 17, 2016

(65) Prior Publication Data

US 2017/0106653 A1 Apr. 20, 2017

(30) Foreign Application Priority Data

Oct. 19, 2015 (JP) ..... 2015-205299

(51) Int. Cl.
*B41J 2/14* (2006.01)
*B41J 2/16* (2006.01)

(52) U.S. Cl.
CPC ..... *B41J 2/14201* (2013.01); *B41J 2/14233* (2013.01); *B41J 2/161* (2013.01); *B41J 2/1607* (2013.01); *B41J 2/1623* (2013.01); *B41J 2/1628* (2013.01); *B41J 2/1629* (2013.01); *B41J 2/1634* (2013.01); *B41J 2/1643* (2013.01); *B41J 2002/14491* (2013.01); *B41J 2202/18* (2013.01)

(58) Field of Classification Search
CPC ..... B41J 2/14201; B41J 2/161; B41J 2/1628; B41J 2/1629; B41J 2/14233; B41J 2/1607; B41J 2/1623; B41J 2/1634; B41J 2/1643; B41J 2002/14491; B41J 2202/18
See application file for complete search history.

(56) References Cited

U.S. PATENT DOCUMENTS 4,851,862 A * 7/1989 Newman ..... B41J 2/45 347/238
2016/0276571 A1* 9/2016 Tanaka ..... B41J 2/14201

FOREIGN PATENT DOCUMENTS

| | | |
|---|---|---|
| JP | 2011-115972 | 6/2011 |
| JP | 2012-111996 | 6/2012 |
| JP | 2012-126028 | 7/2012 |

* cited by examiner

*Primary Examiner* — Alessandro Amari
*Assistant Examiner* — Roger W Pisha, II
(74) *Attorney, Agent, or Firm* — Workman Nydegger

(57) ABSTRACT

A liquid ejecting head includes a first substrate in which a piezoelectric element is provided; and a second substrate on which the first substrate is connected to a first surface, in which the second substrate is provided with a penetration hole, which penetrates through the second substrate in a plate thickness direction, and penetration wiring, which is formed from a conductor that is formed in an inner portion of the penetration hole, the penetration wiring is formed from a first end portion, which is provided on a first surface side, a second end portion, which is provided on a second surface side, which is a surface that is on an opposite side to the first surface, and connection wiring, which connects the first end portion and the second end portion, and a cross-sectional area of the connection wiring in a planar direction of the first surface is smaller than cross-sectional areas of the first end portion and the second end portion in the planar direction.

8 Claims, 7 Drawing Sheets

LIQUID EJECTING HEAD, AND MANUFACTURING METHOD OF LIQUID EJECTING HEAD

The entire disclosure of Japanese Patent Application No: 2015-205299, filed Oct. 19, 2015 is expressly incorporated by reference herein in its entirety.

BACKGROUND

1. Technical Field

The present invention relates to a liquid ejecting head that is provided with a substrate on which wiring that penetrates through a plate thickness direction, is formed, and a manufacturing method of a liquid ejecting head.

2. Related Art

A liquid ejecting apparatus is an apparatus that is provided with a liquid ejecting head, and that ejects various liquids from the liquid ejecting head. Image recording apparatuses such as ink jet printers and ink jet projectors are examples of such liquid ejecting apparatuses, but in recent years, liquid ejecting apparatuses have also been applied to various manufacturing apparatuses to make use of the feature of being able to accurately land a very small quantity of liquid in a predetermined position. For example, liquid ejecting apparatuses have been applied to display manufacturing apparatuses that manufacture color filters such as liquid crystal displays, electrode formation apparatuses that form electrodes such as organic Electro Luminescence (EL) displays and Field Emitting Displays (FEDs), and chip manufacturing apparatuses that manufacture biochips (biochemical elements). Further, liquid form ink is ejected in recording heads for image recording apparatuses, and solutions of each color material of Red (R), Green (G), and blue (B) are ejected in color material ejecting heads for display manufacturing apparatuses. In addition, liquid form electrode materials are ejected in electrode material ejecting heads for electrode formation apparatuses, and solutions of living organic material are ejected in living organic material ejecting heads for chip manufacturing apparatuses.

In the abovementioned liquid ejecting heads, a pressure chamber formation substrate on which a pressure chamber that is in communication with a nozzle, is formed, a piezoelectric element (a kind of actuator) that brings about a pressure fluctuation in liquid inside the pressure chamber, a sealing plate (also referred to as an interposer board) in which a gap is opened and disposed to correspond to the corresponding piezoelectric element, and the like are laminated. Further, the above-mentioned piezoelectric element is driven by a driving signal that is supplied from a driving IC (also referred to as a driver IC). This kind of driving IC is installed in a Tape Carrier Package (TCP) which is connected to an upper surface (a surface that is on an opposite side to a piezoelectric element) of a sealing plate, or is directly installed on the upper surface of the sealing plate, and supplies a driving signal to the piezoelectric element through wiring that is formed on the sealing plate. The wiring that relays between the driving IC and the piezoelectric element is configured from outer surface wiring that is formed on the upper surface and the lower surface of the sealing plate, penetration wiring that is formed inside a penetration hole and penetrates through the sealing plate, and the like (for example, JP-A-2012-126028).

Incidentally, for example, a method that grows a conductor (a metal) inside a penetration hole, in which an adhesive layer (a seed layer), which improves adhesive properties with a conductor, is formed as a film, using an electrolytic plating technique by forming the adhesive layer as a film inside the penetration hole using a sputtering technique or the like, is an example of a method that forms penetration wiring inside the penetration hole of the above-mentioned sealing plate. However, in accordance with the miniaturization of liquid ejecting heads, when the internal diameter of the penetration hole is reduced, and the aspect ratio (a ratio of the length L of the penetration hole (or the substrate thickness) with respect to the opening diameter D of the penetration hole, that is, L/D) of the penetration hole is increased, it is difficult to form the adhesive layer in an inner portion of the penetration hole. Therefore, a sputtering technique that can form an adhesive layer having a favorable coverage (covering) ratio up to the inner portion, in even a penetration hole having a comparatively large aspect ratio, was developed (refer to JP-A-2012-111996).

As the miniaturization of liquid ejecting heads continues, and aspect ratios of penetration holes are further increased, there is a concern that it will not be possible to form a sufficient adhesive layer even using the method that is disclosed in JP-A-2012-111996. That is, there is a concern that the coverage (covering) ratio of the adhesive layer in the inner portion inside the penetration hole will deteriorate. As a result of this, when the adhesive properties of a conductor, which is formed inside the penetration hole, and the inner wall of the penetration hole deteriorate, and heat is applied due to a subsequent manufacturing process, a specification environment of a product, or the like, there is a concern that the conductor inside the penetration hole will stick out (protrude), or will slip out, to an outer side from the penetration hole due to a difference in the thermal expansion coefficients of the sealing plate and the conductor. In addition, even supposing it is possible to form an adhesive layer inside the penetration hole, when the difference between the thermal expansions of the sealing plate and the conductor is large, there is a concern that sticking out, or slipping out of the conductor will occur.

SUMMARY

An advantage of some aspects of the invention is to provide a liquid ejecting head, and a manufacturing method of a liquid ejecting head that can suppress a circumstance in which penetration wiring sticks out from the penetration hole even when heat, an external force, or the like is applied thereto.

According to an aspect of the invention, there is provided a liquid ejecting head including a first substrate in which a piezoelectric element is provided, and a second substrate on which the first substrate is connected to a first surface, the second substrate is provided with a penetration hole, which penetrates through the second substrate in a plate thickness direction, and penetration wiring, which is formed from a conductor that is formed in an inner portion of the penetration hole, the penetration wiring is formed from a first end portion, which is provided on a first surface side, a second end portion, which is provided on a second surface side, which is a surface that is on an opposite side to the first surface, and connection wiring, which connects the first end portion and the second end portion, and a cross-sectional area of the connection wiring in a planar direction of the first surface is smaller than cross-sectional areas of the first end portion and the second end portion in the planar direction.

In this case, since the cross-sectional area of the connection wiring is smaller than the cross-sectional areas of the of the first end portion and the second end portion, it is possible to suppress a circumstance in which the penetration wiring sticks out to an outer side of the penetration hole even when heat, an external force, or the like, is applied to the second substrate.

In the liquid ejecting head, it is preferable that the cross-sectional area of the first end portion or the second end portion in the planar direction of the first surface increases from the connection wiring toward the first surface or the second surface.

In this case, since it is possible to create a portion of the penetration hole using a wet etching technique, the manufacture of the second substrate is facilitated. In addition, it is possible to reduce an angle inside the penetration hole at which it is easy for an electric field and stress to concentrate.

In the liquid ejecting head, it is preferable that an electrode terminal, which performs electrical connection with the first substrate, is formed on the first surface of the second substrate, and that the electrode terminal is formed on an outer surface of a resin that is formed on the first surface.

In this case, since a resin is elastically deformed when the electrode terminal is connected to a terminal of a first substrate side as a result of applying pressure to the first substrate side, it is possible to reliably connect the electrode terminal due to a small increase in weight. In addition, even if heat is applied during the formation of the resin, it is possible to suppress a circumstance in which the penetration wiring sticks out to the outer side from the penetration hole due to a difference in the thermal expansion coefficients (the linear expansion coefficients) of the second substrate and the penetration wiring.

In the liquid ejecting head, it is preferable that the penetration wiring is disposed extending in a direction that is perpendicular to the first surface.

In this case, it is easy to form the penetration wiring, and therefore, the manufacture of the second substrate is further facilitated.

According to another aspect of the invention, there is provided a manufacturing method of a liquid ejecting head that includes a first substrate in which a piezoelectric element is provided, and a second substrate on which the first substrate is connected to a first surface, the method including forming a first recessed portion on the first surface of the second substrate, forming a second recessed portion on the second surface, which is on an opposite side to the first surface, of the second substrate, forming a penetration channel, a cross-sectional area in the planar direction of the first surface of which is smaller than those of the first recessed portion and the second recessed portion, between the first recessed portion and the second recessed portion, and causing the penetration channel to penetrate through the second substrate, and forming a conductor in an inner portion of each of the first recessed portion, the second recessed portion and the penetration channel using an electrolytic plating technique.

In this case, it is possible to easily form a conductor (that is, penetration wiring) in which the cross-sectional area on a surface that is parallel to the first surface, increases from midway in the plate thickness direction of the second substrate toward the first surface and the second surface that is on the opposite side to the first surface. In addition, since the conductor is formed using an electrolytic plating technique, it is possible to reliably form the conductor inside the penetration channel in even a case in which the aspect ratio of the penetration channel is high.

In the manufacturing method of a liquid ejecting head, it is preferable that at least one of the forming of the first recessed portion and the forming of the second recessed portion includes removing the second substrate using a dry etching technique.

In this case, it is possible to form the first recessed portion or the second recessed portion with high accuracy.

In the manufacturing method of a liquid ejecting head, it is preferable that at least one of the forming of the first recessed portion and the forming of the second recessed portion includes removing the second substrate using a wet etching technique.

In this case, it is possible to form the first recessed portion or the second recessed portion in a short period of time. In addition, if a crystalline substrate on which etching proceeds in a direction that is inclined with respect to the first surface, is used as the second substrate, it is possible to configure an inner wall of the first recessed portion or the second recessed portion as an inclined surface. As a result of this, it is possible to reduce an angle at which it is easy for an electric field and stress to concentrate.

In the manufacturing method of a liquid ejecting head, it is preferable that the forming of the conductor includes a laser machining technique.

In this case, it is possible to form a penetration channel having a high aspect ratio.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, aspects for implementing the invention will be described with reference to the appended drawings. Additionally, since the embodiments that are mentioned below are preferred specific examples of the invention, various limitations have been applied thereto, but the scope of the invention is not limited to these aspects unless a feature that specifically limits the invention is disclosed in the following description. In addition, in the following description, examples of an ink jet type recording head (hereinafter, referred to as a recording head), which is a type of a liquid ejecting head, and an ink jet type printer (hereinafter, referred to as a printer), which is a type of liquid ejecting apparatus, in which such an ink jet type recording head is mounted, are illustrated as examples.

Figure 1:
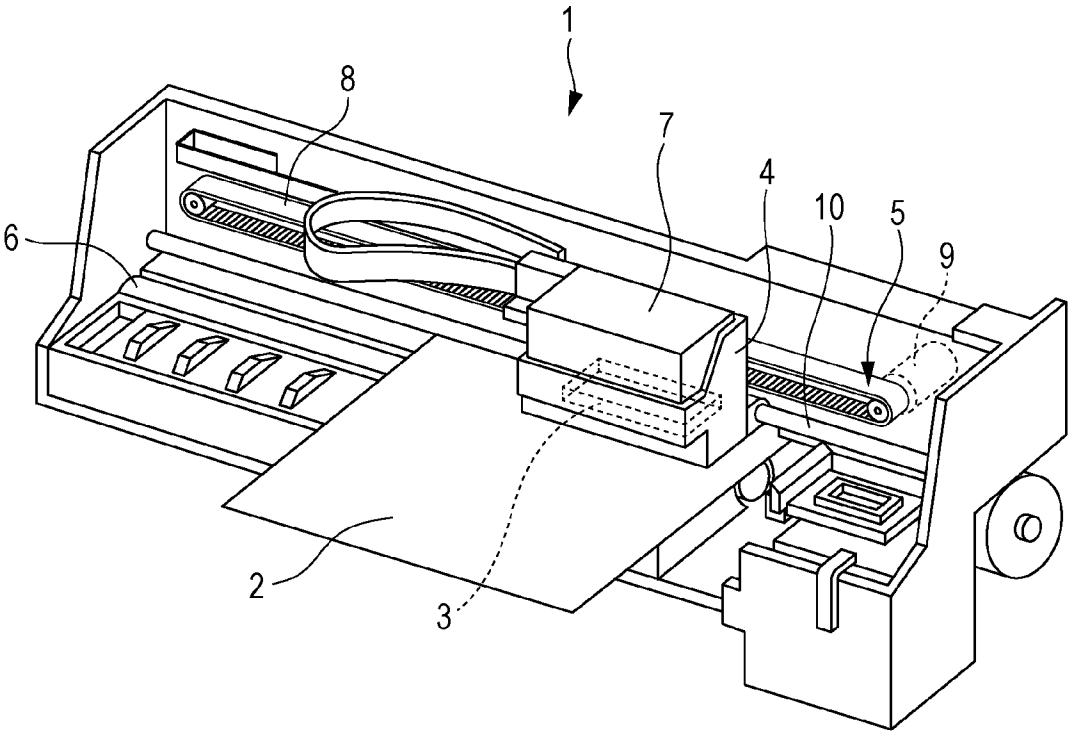
FIG. 1 is a perspective view that describes a configuration of a printer.

A configuration of a printer 1 will be described with reference to FIG. 1. The printer 1 is an apparatus that performs the recording of images or the like by ejecting an ink (a type of liquid) onto an outer surface of a recording medium 2 (a type of landing target) such as recording paper. The printer 1 is provided with a recording head 3, a carriage 4 to which the recording head 3 is attached, a carriage movement mechanism 5 that moves the carriage 4 in a main scanning direction, a transport mechanism 6 that transfers the recording medium 2 in a sub-scanning direction, and the like. In this instance, the abovementioned ink is retained in ink cartridges 7 as liquid supply sources. The ink cartridges 7 are installed in the recording head 3 in an attachable and detachable manner. Additionally, it is possible to adopt a configuration in which the ink cartridges are disposed on a main body side of the printer, and ink is supplied to the recording head from the ink cartridges through an ink supply tube.

The carriage movement mechanism 5 is provided with a timing belt 8. Further, the timing belt 8 is driven by a pulse motor 9 such as a DC motor. Accordingly, when the pulse motor 9 is activated, the carriage 4 reciprocates in the main scanning direction (a width direction of the recording medium 2) guided on a guide rod 10, which is provided in a hanging manner in the printer 1. The position of the carriage 4 in the main scanning direction is detected by a linear encoder (not illustrated in the drawings), which is a type of positional information detection unit. The linear encoder sends a detection signal thereof, that is, an encoder pulse (a type of positional information) to a control section of the printer 1.

Figure 2:
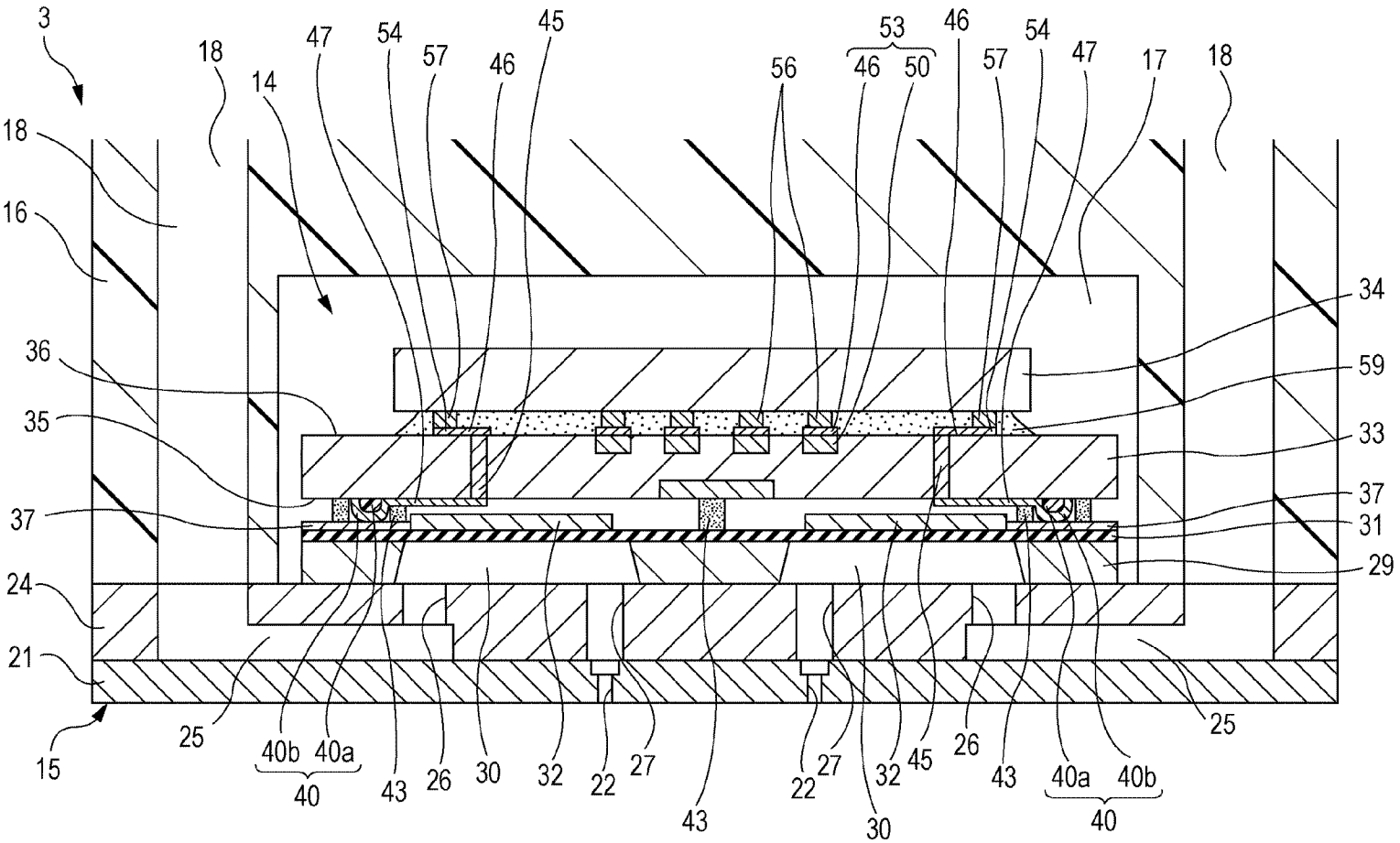
FIG. 2 is a cross-sectional view that describes a configuration of a recording head.
Figure 3:
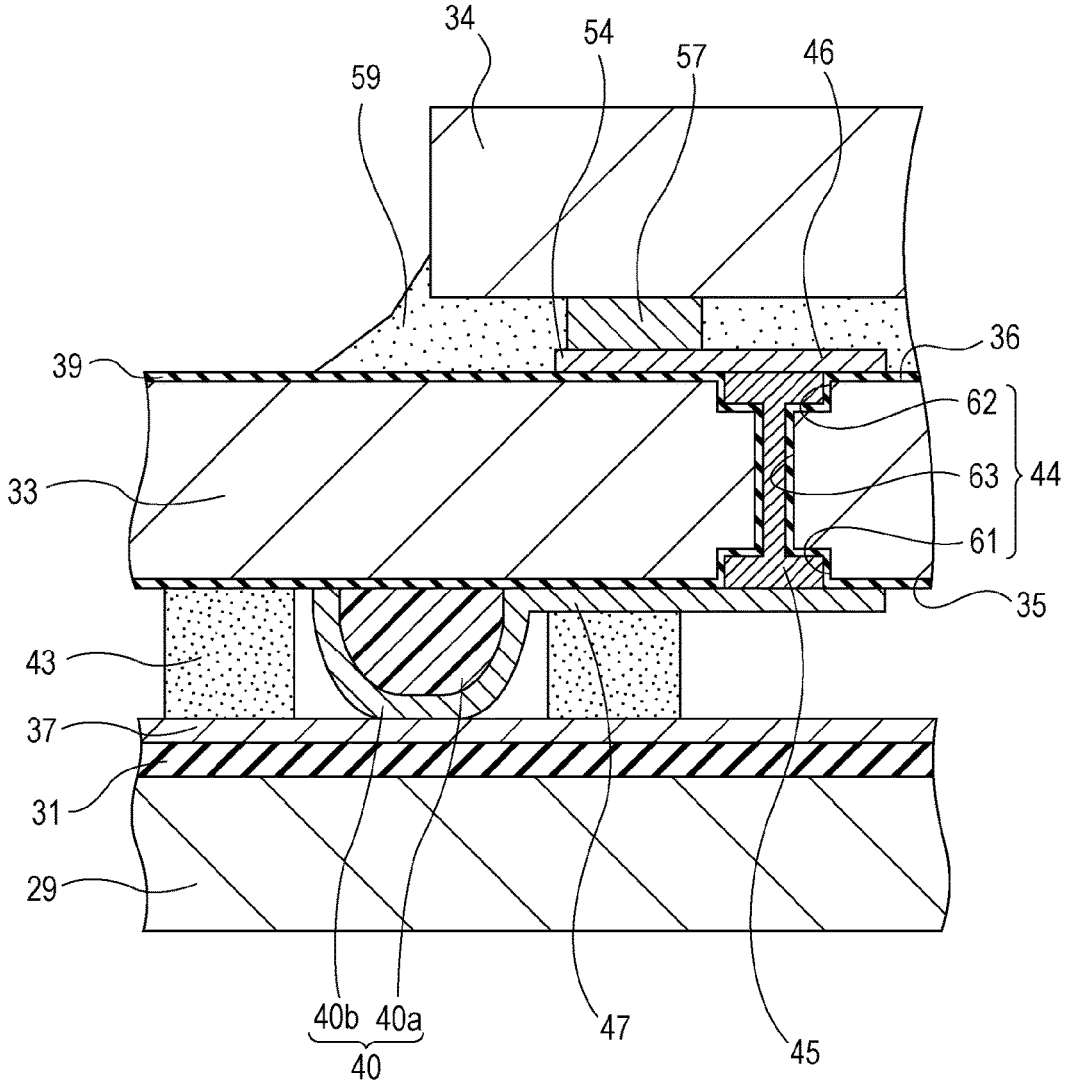
FIG. 3 is a cross-sectional view in which main portions of a sealing plate are enlarged.
Figure 4:
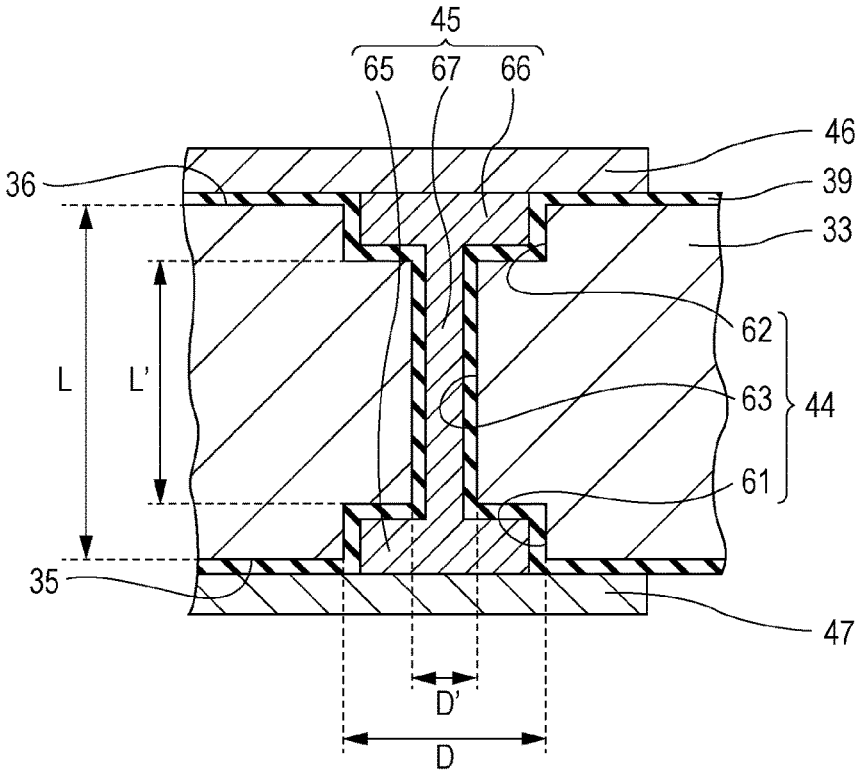
FIG. 4 is a cross-sectional view that describes a configuration of penetration wiring.

Next, the recording head 3 will be described. FIG. 2 is a cross-sectional view that describes a configuration of the recording head 3. FIG. 3 is a cross-sectional view in which the main parts of a sealing plate 33 are enlarged. FIG. 4 is a cross-sectional view that describes a configuration of penetration wiring 45. As shown in FIG. 2, the recording head 3 in the present embodiment is attached to a head case 16 in a state in which a piezoelectric device 14 and a flow channel unit 15 are laminated. Additionally, for the convenience of description, the lamination direction of each member will be described as the up-down direction.

The head case 16 is a synthetic resin box-shaped member, and liquid introduction paths 18 that supply ink to common liquid chambers 25, which will be described later, are formed in an inner section thereof. The liquid introduction paths 18 are spaces in which ink that is common to pressure chambers 30 that are arranged in parallel in a plurality, is stored in addition to the common liquid chambers 25, which will be described later. In the present embodiment, two liquid introduction paths 18 are formed to correspond to a row of the pressure chambers 30, which are arranged in parallel in two rows. In addition, an accommodation space 17, which is recessed in a rectangular parallelepiped shape from a lower surface side of the head case 16 to midway in a height direction of the head case 16, is formed between the two liquid introduction paths 18. The piezoelectric device 14 (a pressure chamber formation substrate 29, a sealing plate 33, and the like), which is laminated on a communication substrate 24, is accommodated inside the accommodation space 17.

The flow channel unit 15, which is joined to the lower surface of the head case 16, includes the communication substrate 24, and a nozzle plate 21. The communication substrate 24 is a plate material made from silicon, and in the present embodiment, is prepared from a monocrystalline silicon substrate in which the crystal plane orientation of the outer surfaces (the upper surface and the lower surface) is set as (110). As shown in FIG. 2, the common liquid chambers 25, which are in communication with the liquid introduction paths 18, and in which ink that is common to each pressure chamber 30 is stored, and individual communication channels 26 that individually supply ink from the liquid introduction paths 18 to each pressure chamber 30 via the common liquid chambers 25, are formed in the communication substrate 24 using etching (a wet etching technique or a dry etching technique). The common liquid chambers 25 are longitudinal space sections along a nozzle row direction, and two rows of the common liquid chambers 25 are formed to correspond to a row of pressure chambers 30, which are arranged in parallel in two rows. A plurality of the individual communication channels 26 are opened in positions of the common liquid chambers 25 that correspond to the pressure chambers 30. That is, a plurality of the individual communication channels 26 are formed along a parallel arrangement direction of the pressure chambers 30. The individual communication channels 26 are in communication with an end section of one side in the longitudinal direction of a corresponding pressure chamber 30 in a state in which the communication substrate 24 and the pressure chamber formation substrate 29 are joined.

In addition, nozzle communication channels 27, which penetrate through the plate thickness direction of the communication substrate 24, are formed in positions that correspond to each nozzle 22 of the communication substrate 24. That is, the nozzle communication channels 27 are formed in a plurality along a corresponding nozzle row direction, which corresponds to a nozzle row. The pressure chambers 30 and the nozzles 22 are in communication with one another due to these nozzle communication channels 27. The nozzle communication channels 27 of the present embodiment are in communication with an end section of the other side in the longitudinal direction of a corresponding pressure chamber 30 (a side that is opposite to the individual communication channel 26) in a state in which the communication substrate 24 and the pressure chamber formation substrate 29 are joined.

The nozzle plate 21 is a substrate made from silicon (for example, a monocrystalline silicon substrate), which is joined to the lower surface of the communication substrate 24 (a surface on a side that is opposite to the pressure chamber formation substrate 29). In the present embodiment, openings that are on a lower surface side of the spaces that correspond to the common liquid chambers 25 are sealed by the nozzle plate 21. In addition, a plurality of nozzles 22 are provided in an open manner in the nozzle plate 21 in a linear manner (row form). In the present embodiment, two nozzle rows are formed to correspond to a row of pressure chambers 30, which are formed in two rows. A plurality of nozzles 22 that are arranged in parallel (a nozzle row) are provided at regular intervals along the sub-scanning direction, which is orthogonal to the main scanning direction, from a nozzle 22 of one end side to a nozzle 22 of the other end side with a pitch that corresponds to a dot formation density. Additionally, it is also possible to seal the openings that are on the lower surface side of the spaces that correspond to the common liquid chambers with a member such as a compliance sheet that has a flexible property, for example, by joining the nozzle plate to a region of the communication substrate that is separated on the inner side from the common liquid chambers. If configured in this manner, it is possible to make the nozzle plate as small as possible.

As shown in FIG. 2, the piezoelectric device 14 of the present embodiment is unitized by laminating the pressure chamber formation substrate 29, a vibration plate 31, piezoelectric elements 32, the sealing plate 33, and a driving IC 34, and is accommodated inside the accommodation space 17.

The pressure chamber formation substrate 29 is a hard silicon plate material, and in the present embodiment, is prepared from a monocrystalline silicon substrate in which the crystal plane orientation of the outer surfaces (the upper surface and the lower surface) is set as (110). A plurality of spaces, which correspond to the pressure chambers 30, are arranged in parallel in the pressure chamber formation substrate 29 along the nozzle row direction, as a result of portions being completely removed in the plate thickness direction by etching. The spaces configure the pressure chambers 30 as a result of the lower sections thereof being partitioned by the communication substrate 24, and the upper sections thereof being partitioned by the vibration plate 31. In addition, the spaces, that is, the pressure chambers 30 are formed in two rows to correspond to the nozzle rows that are formed in two rows. Each pressure chamber 30 is formed longitudinally in a direction that is orthogonal to the nozzle row direction, an individual communication channel 26 is in communication with the end section of one side in the longitudinal direction, and a nozzle communication channel 27 is in communication with the end section of the other side.

The vibration plate 31 is a thin film form member that has an elastic property, and is laminated onto an upper surface of the pressure chamber formation substrate 29 (a surface on a side that is opposite to the communication substrate 24). Upper section openings of the spaces that correspond to the pressure chambers 30 are sealed by the vibration plate 31. In other words, the upper surfaces of the pressure chambers 30 are partitioned by the vibration plate 31. Portions of the vibration plate 31 that correspond to the pressure chambers 30 (or to explain in more detail, the upper section openings of the pressure chambers 30) function as displacement sections that are displaced in a direction that becomes distant from or a direction that approaches the nozzles 22 in accordance with flexural deformation of the piezoelectric elements 32. That is, regions of the vibration plate 31 that correspond to the upper section openings of the pressure chambers 30 correspond to driving regions in which flexural deformation is permitted. The cubic capacity of the pressure chambers 30 changes depending on the deformation (displacement) of the driving regions (displacement sections). Meanwhile, regions of the vibration plate 31 that are separated from the upper section openings of the pressure chambers 30 correspond to non-driving regions in which flexural deformation is inhibited. Additionally, the pressure chamber formation substrate 29 and the vibration plate 31 that is laminated thereon, correspond to the first substrate of the invention.

The piezoelectric elements 32 of the present embodiment, are so-called flexural mode piezoelectric elements. For example, in the piezoelectric elements 32, a lower electrode layer, a piezoelectric body layer, and an upper electrode layer are sequentially laminated onto the vibration plate 31 in regions that correspond to each pressure chamber 30. When an electric field depending on a difference in potential between the two electrodes is applied between the lower electrode layer and the upper electrode layer, the piezoelectric elements 32, which are configuration in this manner, are flexurally deformed in a direction of becoming distant from or a direction of approaching the nozzles 22. In addition, each piezoelectric element 32 is formed in two rows along the nozzle row direction to correspond to the pressure chambers 30, which are arranged in parallel in two rows along the nozzle row direction. Furthermore, as shown in FIG. 2, driving wiring 37 is routed from each piezoelectric element 32 to further on an outer side than the piezoelectric elements 32 (that is, to a non-driving region). The driving wiring 37 is wiring that supplies a driving signal for driving the piezoelectric elements 32 to the piezoelectric elements 32, and is disposed extending along a direction that is orthogonal to the nozzle row direction (that is, the parallel arrangement direction of the piezoelectric elements 32) from the piezoelectric elements 32 up to an end section of the vibration plate 31.

As shown in FIG. 2 and FIG. 3, the sealing plate 33 (equivalent to the second substrate of the invention) is a flat plate form substrate that is connected to the vibration plate 31 in a manner in which a space is formed between a first surface 35, which is a lower surface, and the vibration plate 31 (or the piezoelectric elements 32). In the present embodiment, the sealing plate 33 and the pressure chamber formation substrate 29 (or to explain in more detail, the pressure chamber formation substrate 29, which is equivalent to the first substrate of the invention and onto which the vibration plate 31 is laminated) are joined using a photosensitive adhesive 43 having both a thermosetting property and a photosensitive property. In addition, the sealing plate 33 is prepared from a monocrystalline silicon substrate in which the crystal plane orientation of the outer surfaces (the upper surface and the lower surface) is set as (110). Additionally, for example, the outer surfaces of the sealing plate 33 are covered by an insulation film 39, which is formed from $SiO_2$, SiN, or the like.

The driving IC 34, which outputs driving signals for driving the piezoelectric elements 32, is disposed on a second surface 36, which is an upper surface of the sealing plate 33 (a surface on a side that is opposite to the first surface 35 (the surface on the piezoelectric element 32 side)). In addition, a plurality of resin core bumps 40, which output the driving signals from the driving IC 34 to the piezoelectric element 32 side, are formed on the first surface 35 of the sealing plate 33. As shown in FIG. 2, the resin core bumps 40 are respectively formed in a plurality along the nozzle row direction in a position that corresponds to one driving wiring 37 that is disposed extending from a row of one piezoelectric element 32, and a position that corresponds to the other driving wiring 37 that is disposed extending from a row of the other piezoelectric element 32. Further, each resin core bump 40 is connected to respective corresponding driving wiring 37.

The resin core bumps 40 in the present embodiment have an elastic property, and are provided protruding toward a side of the vibration plate 31 in regions of the sealing plate 33 that face the driving wiring 37 (more specifically, terminal sections of the driving wiring 37). More specifically, as shown in FIG. 2 and FIG. 3, the resin core bumps 40 are provided with a resin section 40*a* (equivalent to a resin of the invention) that is formed from an elastic body and is formed (provided in a protruding manner) on the first surface 35 of the sealing plate 33, and an electrode layer 40*b* (equivalent to an electrode terminal of the invention) that is formed along the outer surface of a vibration plate 31 side of the corresponding resin section 40*a*. The resin section 40*a* in the present embodiment, is formed into a protrusion along the nozzle row direction on the lower surface of the sealing plate 33. In addition, the electrode layer 40*b* is formed in a plurality along the nozzle row direction to correspond to the piezoelectric elements 32, which are arranged in parallel along the nozzle row direction. That is, the resin core bumps 40 are formed in a plurality along the nozzle row direction.

Further, the surfaces of the sides of the resin section 40*a* and the electrode layer 40*b* that face the driving wiring 37 (the lower surfaces of the resin core bumps 40) are formed curving in an arc shape toward a pressure chamber formation substrate 29 side in a cross-sectional view in a direction that is orthogonal the nozzle row direction. Such resin core bumps 40 are electrically connected to the driving wiring 37 that is on the pressure chamber formation substrate 29 as a result of a portion of the arc shape of the lower surfaces thereof being elastically deformed due to being pressed against corresponding driving wiring 37 (the terminal section of the driving wiring 37). That is, the electrode layers 40*b* and the driving wiring 37 (the terminal section of the driving wiring 37) are electrically connected in a state in which the resin section 40*a* is elastically deformed as a result of an increase in weight between the sealing plate 33 and the pressure chamber formation substrate 29 (a direction in which the two members come into contact with one another). The electrode layers 40*b* function as electrode terminals that perform electrical connection of wiring (lower surface side wiring 47) on a sealing plate 33 side and wiring of the pressure chamber formation substrate 29 side (the driving wiring 37). In this manner, it is possible to reliably connect the electrode layers 40*b* with a small increase in weight as a result of the resin sections 40*a* being elastically deformed.

Additionally, the resin sections 40*a* of the resin core bumps 40 are created by applying heat after patterning of a resin on the sealing plate 33. More specifically, a resin film is formed on the lower surface of the sealing plate 33, and the resin is patterned in a position that corresponds to the resin section 40*a* using etching, or the like. Thereafter, for example, the resin section 40*a* in which a tip end portion is curved, is formed by rounding the angles thereof by heating to approximately 250° C. Additionally, for example, a resin that has an elastic property, and is formed from a polyimide resin, a phenol resin, an epoxy resin, or the like, can be used as the resin sections 40*a*. In addition, a metal that is formed from gold (Au), titanium (Ti), aluminum (Al) chromium (Cr), nickel (Ni), copper (Cu), an alloy thereof, or the like, can be used as the electrode layers 40*b*.

In addition, each electrode layer 40*b* corresponds to lower surface side wiring 47 that, on the lower surface of the sealing plate 33, is separated and disposed extending on the inner side (the piezoelectric element 32 side) along a direction that is orthogonal to the nozzle row direction from above the resin section 40*a*. The lower surface side wiring 47 is wiring that connects the resin core bumps 40 and the penetration wiring 45 (to be described later), and is disposed extending from a position that corresponds to the electrode layer 40*b* above the resin section 40*a* to a position that corresponds to the penetration wiring 45. In other words, a portion of the lower surface side wiring 47 that is formed on the lower surface of the sealing plate 33 forms the electrode layer 40*b* of the resin core bump 40 as a result of being disposed extending along a direction that is orthogonal to the nozzle row direction from a position that corresponds to the penetration wiring 45 up to above the resin section 40*a*.

Furthermore, as shown in FIG. 2, a plurality (four in the present embodiment) of pieces of power source wiring 53 that supplies power source voltages, and the like (for example, VDD1 (a power source of a low voltage circuit), VDD2 (a power source of a high voltage circuit), VSS1 (a power source of a low voltage circuit), and VSS2 (a power source of a high voltage circuit)) to the driving IC 34, are formed in a central section on the upper surface of the sealing plate 33 (a region that is separated from regions that correspond to the resin core bumps 40). The power source wiring 53 is formed from upper surface side embedded wiring 50, which is embedded in the upper surface of the sealing plate 33, and upper surface side wiring 46, which is laminated in a manner that covers the upper surface side embedded wiring 50. Power source bump electrodes 56 of the corresponding driving IC 34 are electrically connected to the top of the upper surface side wiring 46 of the power source wiring 53. Additionally, the upper surface side embedded wiring 50 is formed from a metal (a conductor) such as copper (Cu).

In addition, as shown in FIG. 2 and FIG. 3, driving bump electrodes 57 of the driving IC 34 are connected, and connection terminals 54 into which signals from the driving IC 34 are input, are formed, in regions of both end sides on the upper surface of the sealing plate 33 (to explain in more detail, regions that are separated on the outer sides from regions in which the power source wiring 53 is formed, and that correspond to the resin core bumps 40). The connection terminals 54 are formed in a plurality along the nozzle row direction corresponding to the piezoelectric elements 32. The upper surface side wiring 46 is disposed extending toward the inner side (the piezoelectric element 32 side) from each connection terminal 54. The upper surface side wiring 46 is connected to corresponding lower surface side wiring 47 via the penetration wiring 45. Additionally, the configuration of the penetration wiring 45 will be mentioned in more detail later.

The driving IC 34, which is disposed on the sealing plate 33, is an IC chip that outputs signals for driving the piezoelectric elements 32, and is laminated on the second surface 36 of the sealing plate 33 using an adhesive 59 such as an anisotropic conductive film (ACF). As shown in FIG. 2 and FIG. 3, the power source bump electrodes 56, which are connected to the power source wiring 53, and the driving bump electrodes 57, which are connected to the connection terminals 54, are provided in a plurality along the nozzle row direction on the surface of the sealing plate 33 side of the driving IC 34. The power source bump electrodes 56 are terminals that take in a voltage (electric power) from the power source wiring 53 to a circuit inside the driving IC 34. In addition, the driving bump electrodes 57 are terminals that output signals that drives each piezoelectric element 32. The driving bump electrodes 57 in the present embodiment are formed in two rows on both sides of the power source bump electrodes 56 to correspond to a row of the piezoelectric elements 32, which are arranged in parallel in two rows.

Further, in the recording head 3 having the above-mentioned configuration, ink is introduced from the ink cartridges 7 to the pressure chambers 30 through the liquid introduction paths 18, the common liquid chambers 25 and the individual communication channels 26. In this state, the piezoelectric elements 32 are driven and pressure fluctuations are generated in the pressure chambers 30 by supplying driving signals from the driving IC 34 to the piezoelectric elements 32 through each piece of wiring that is formed on the sealing plate 33. The recording head 3 ejects ink droplets from the nozzles 22 through the nozzle communication channels 27 using the pressure fluctuations.

Next, the configuration of the penetration wiring 45 will be described in detail. As shown in FIG. 3 and FIG. 4, the penetration wiring 45 is wiring that relays between the first surface 35 and the second surface 36 of the sealing plate 33 (or more specifically, the lower surface side wiring 47 and the upper surface side wiring 46), and extends in a direction (that is, a plate thickness direction) that is perpendicular to the first surface 35. The penetration wiring 45 is formed from a conductor such as a metal, and an inner portion of a penetration hole 44, which penetrates through the sealing plate 33 in the plate thickness direction, is filled by the penetration wiring 45. In other words, the penetration wiring 45 is formed from a conductor, which is formed in the inner portion of the penetration hole 44, which penetrates through the sealing plate 33 in the plate thickness direction. Additionally, in the conductor that corresponds to the penetration wiring 45 of the present embodiment, copper (Cu) is used since it is possible to easily manufacture using an electrolytic plating technique.

As shown in FIG. 4, the cross-sectional area of the penetration hole 44 on a surface (that is, a surface that is perpendicular to a planar direction of the first surface 35, or the plate thickness direction) that is parallel to the first surface 35 increases from midway in the plate thickness direction of the sealing plate 33 toward the first surface 35 and the second surface 36. In other words, the cross-sectional area of the penetration hole 44 from the first surface 35 up to a predetermined range (a formation range of a first recessed portion 61 which will be described later) in the plate thickness direction, and the cross-sectional area from the second surface 36 up to a predetermined range (a formation range of a second recessed portion 62 which will be described later) in the plate thickness direction are greater than the cross-sectional area of the penetration hole 44 in a remaining range (a formation range of a penetration channel 63, which will be described later). Therefore, the cross-sectional area of the penetration wiring 45, with which the penetration hole 44 is filled, on the surface that is parallel to the first surface 35 also increases from midway in the plate thickness direction of the sealing plate 33 toward the first surface 35 and the second surface 36. More specifically, as shown in FIG. 4, the penetration hole 44 is provided with the first recessed portion 61 in which a portion of the sealing plate 33 on the first surface 35 is removed up to midway in the plate thickness direction, the second recessed portion 62 in which a portion of the sealing plate 33 on the second surface 36 is removed up to midway in the plate thickness direction, and the penetration channel 63, the cross-sectional area on the surface (a surface that is perpendicular to the plate thickness direction) that is parallel to the first surface 35, of which is smaller than those of the first recessed portion 61 and the second recessed portion 62. The first recessed portion 61 and the second recessed portion 62 in the present embodiment are partitioned by a side wall that extends in a direction that is perpendicular to the first surface 35 (or the second surface 36), and a bottom surface that is parallel to the first surface 35 (or the second surface 36). Further, the cross-sectional areas of both recessed portions 61 and 62 are aligned to be substantially the same area. The penetration channel 63 is an oblong hole that communicates between a bottom surface of the first recessed portion 61 and a bottom surface of the second recessed portion 62. An upper end of the penetration channel 63 in the present embodiment is open to a central portion of the bottom surface of the first recessed portion 61, and a lower end thereof is open to a central portion of the bottom surface of the second recessed portion 62.

Further, the penetration wiring 45, with which the inner portion of the penetration hole 44 is filled, is formed from a first end portion 65, which is formed inside the first recessed portion 61, a second end portion 66, which is formed inside the second recessed portion 62, and connection wiring 67, which is formed inside the penetration channel 63. That is, the penetration wiring 45 is provided with the first end portion 65, which extends from the first surface 35 of the sealing plate 33 up to midway in the plate thickness direction, the second end portion 66, which extend from the second surface 36 of the sealing plate 33 up to midway in the plate thickness direction, and the connection wiring 67, which extends from the first end portion 65 up to the second end portion 66. In other words, the penetration wiring 45 is provided with the first end portion 65, which is provided on a first surface 35 side, the second end portion 66, which is provided on a second surface 36 side, and the connection wiring 67, which connects the first end portion 65 and the second end portion 66. Further, the cross-sectional area of the connection wiring 67 on the surface that is parallel to the first surface 35 is formed to be smaller than the cross-sectional areas of the first end portion 65 and the second end portion 66 on the surface that is parallel to the first surface 35.

Additionally, for example, the length L (that is, the thickness of the sealing plate 33) of the penetration hole 44 in the present embodiment is set to approximately 300 μm to 400 μm. In addition, for example, the opening diameter D (the opening diameter of the first recessed portion 61 and the opening diameter of the second recessed portion 62) of the penetration hole 44 is set to be approximately 20 μm to approximately 30 μm depending on the pitch of the nozzles 22. That is, the aspect ratio L/D of the penetration hole 44 is set to be approximately 10 or more. Additionally, the inner walls (that is, the side wall and the bottom surface of the first recessed portion 61, the side wall and the bottom surface of the second recessed portion 62, and the side wall of the penetration channel 63) of the penetration channel 63 are covered using the insulation film 39 in the same manner as the outer surfaces of the sealing plate 33. Further, the penetration wiring 45 is formed on the insulation film 39. That is, the insulation film 39 is formed between the penetration wiring 45 and the penetration hole 44. Further, a portion of the penetration wiring 45 that is exposed to an opening portion of the first recessed portion 61 is covered by the lower surface side wiring 47. In addition, a portion of the penetration wiring 45 that is exposed to an opening section of the second recessed portion 62 is covered by the upper surface side wiring 46. That is, the upper surface side wiring 46, which is disposed extending from the connection terminal 54, and a lower surface side wiring 47, which is disposed extending from a corresponding resin core bump 40, are electrically connected by the penetration wiring 45.

In this manner, since the cross-sectional areas of the penetration hole 44 and the penetration wiring 45 increase toward the first surface 35 and the second surface 36, it is even possible to suppress a circumstance in which the penetration wiring 45 sticks out (protrudes) to an outer side from the penetration hole 44 when heat, an external force, or the like, is applied to the sealing plate 33. For example, in a heating treatment when forming the resin sections 40*a* of the resin core bumps 40 on the sealing plate 33, there is a concern that a force will work in a direction that ejects the penetration wiring 45 from the penetration hole 44 as a result of a difference in the thermal expansion coefficients (the linear expansion coefficients) of the penetration wiring 45 and the sealing plate 33. Even if such a force is at work, since a conductor portion of the penetration wiring 45, with which the inside of the first recessed portion 61 is filled, or a conductor portion of the penetration wiring 45, with which the second recessed portion 62 is filled, are not inserted into the penetration channel 63, these components act as retainers, and therefore, it is possible to suppress a circumstance in which the penetration wiring 45 sticks out to the outer side from the penetration hole 44. In addition, since sticking out (protruding) of the penetration wiring 45 is physically suppressed by the forms of the penetration hole 44 and the penetration wiring 45, it is not necessary to form an adhesive layer for causing the conductor, which corresponds to the penetration wiring 45, to adhere to the inside of the penetration hole 44. In particular, even in a case in which the aspect ratio L/D of the penetration hole 44 is large, and it is not possible to form an adhesive layer in an inner portion of the penetration hole 44, it is possible to fix the penetration wiring 45 to the inside of the penetration hole 44. Furthermore, since the penetration wiring 45 is disposed extending in a direction that is perpendicular to the first surface 35, formation of the penetration wiring 45 is facilitated, and therefore, and manufacture of the sealing plate 33 is further facilitated.

Figure 5:
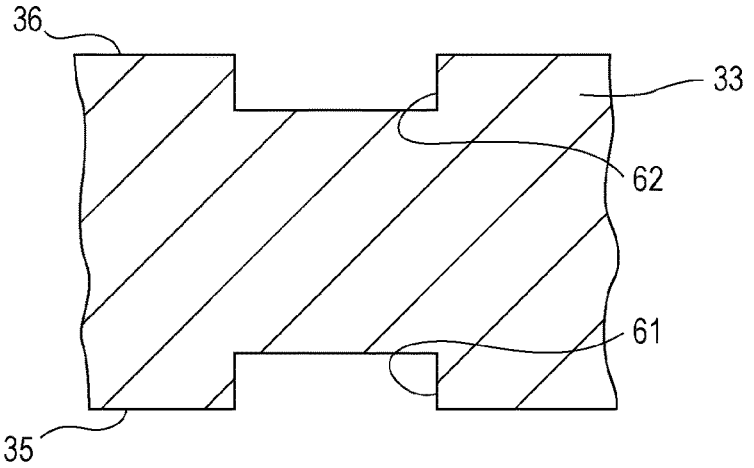
FIG. 5 is a cross-sectional view that describes a manufacturing process of penetration wiring.

Next, a manufacturing method of the penetration wiring 45 will be described. FIG. 5 to FIG. 8 are cross-sectional views that describe a manufacturing process of the penetration wiring 45. Firstly, as shown in FIG. 5, in a first recessed portion formation process, the first recessed portion 61 is formed by removing a portion of the sealing plate 33, which is formed from a monocrystalline silicon substrate, on the first surface 35 up to midway in the plate thickness direction. More specifically, a mask layer, in which a position of the sealing plate 33 that corresponds to the first recessed portion 61, and the like, is open, is formed on the first surface 35 of the sealing plate 33 by carrying out an exposure process and a developing process, and thereafter, the first recessed portion 61 is formed by digging through the sealing plate 33 using a dry etching technique. Once the first recessed portion 61 is formed, the mask layer is removed. Next, in a second recessed portion formation process, the second recessed portion 62 is formed by removing a portion of the sealing plate 33 on the second surface 36 up to midway in the plate thickness direction. That is, in the same manner as the first recessed portion formation process, a mask layer, in which a position of the sealing plate 33 that corresponds to the second recessed portion 62, and the like, is open, is formed on the second surface 36 by carrying out an exposure process and a developing process, and thereafter, the second recessed portion 62 is formed by digging through the sealing plate 33 using a dry etching technique. Once the second recessed portion 62 is formed, the mask layer is removed. Additionally, either one of the first recessed portion formation process and the second recessed portion formation process may be performed first.

Figure 6:
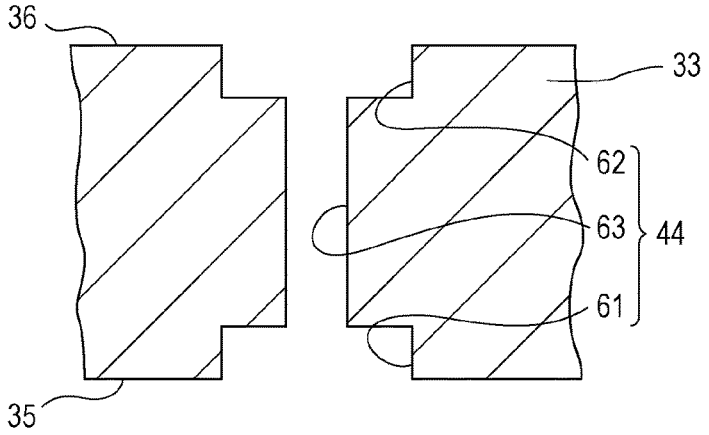
FIG. 6 is a cross-sectional view that describes the manufacturing process of penetration wiring.
Figure 7:
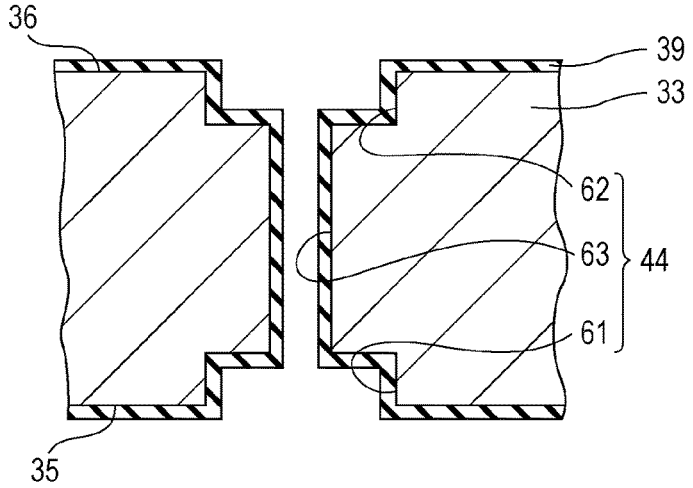
FIG. 7 is a cross-sectional view that describes the manufacturing process of penetration wiring.

Once the first recessed portion 61 and the second recessed portion 62 are formed in the sealing plate 33, as shown in FIG. 6, the penetration channel 63, which penetrates through the first recessed portion 61 and the second recessed portion 62, is formed. That is, the penetration hole 44, which penetrates through the sealing plate 33, is formed. In this instance, the penetration channel 63 is formed so that the cross-sectional area on the surface that is parallel to the first surface 35 (the surface that is perpendicular to the plate thickness direction) so as to be smaller than those of the first recessed portion 61 and the second recessed portion 62. For example, this kind of penetration channel 63 can be formed using dry etching, laser, or the like, such as Deep RIE. In the present embodiment, a laser machining technique is used since it is possible to easily manufacture a penetration channel 63 having a high aspect ratio. Further, once the penetration hole 44 is formed, as shown in FIG. 7, the insulation film 39 is formed on the inner walls of the first surface 35 and the second surface 36 of the sealing plate 33 and the penetration hole 44. The insulation film 39 in the present embodiment is formed from a thermally oxidized film ($SiO_2$), and is formed by performing a thermal oxidation process.

Figure 8:
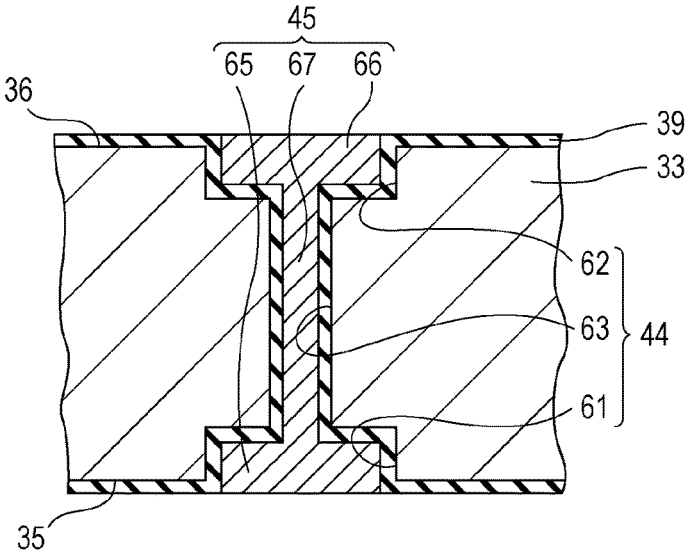
FIG. 8 is a cross-sectional view that describes the manufacturing process of penetration wiring.

Further, lastly, as shown in FIG. 8, in the penetration wiring formation process, a conductor (copper (Cu) in the present embodiment), which corresponds to the penetration wiring 45 (that is, the first end portion 65, the second end portion 66 and the connection wiring 67) is formed in the inner portion of the penetration hole 44 (that is, the first recessed portion 61, the second recessed portion 62 and the penetration channel 63) using an electrolytic plating technique. In addition, in the present embodiment, the penetration wiring 45 is formed without forming the adhesive layer (the seed layer) in the inner portion of the penetration hole 44. Various methods can be adopted as such a method. For example, the adhesive layer (the seed layer) is formed at one opening edge of either the first recessed portion 61 or the second recessed portion 62 using a sputtering technique, and the one recessed portion on which the adhesive layer is formed is blocked using the conductor by growing the conductor on the adhesive layer using an electrolytic plating technique. Further, the inside of the penetration hole 44 is filled with the conductor by setting the conductor that blocked the recessed portion as a core, and growing the conductor from the one recessed portion up to the other recessed portion. Additionally, conductor that is deposited further on the outer sides than the first surface 35 and the second surface 36 of the sealing plate 33 is removed using a Chemical Mechanical Polishing (CMP) technique, or the like. As a result of this, penetration wiring 45 such as that shown in FIG. 8 is formed.

As a result of this kind of method, it is possible to easily create penetration wiring 45 in which the cross-sectional area on a surface that is parallel to the first surface 35, increases from midway in the plate thickness direction of the sealing plate 33 toward the first surface 35 and the second surface 36. As a result of this, in a subsequent manufacturing process, a specification environment of the printer 1, or the like, it is even possible to suppress a circumstance in which the penetration wiring 45 sticks out (protrudes) to an outer side from the penetration hole 44 when heat, an external force, or the like, is applied to the sealing plate 33. In addition, since the penetration wiring 45 is formed using an electrolytic plating technique, it is even possible to reliably form the conductor inside the penetration channel 63 in a case in which the aspect ratio of the penetration channel 63 is high. Furthermore, since the first recessed portion 61 and the second recessed portion 62 are formed using a dry etching technique, it is possible to form the first recessed portion 61 and the second recessed portion 62 with high accuracy. Further, since the penetration wiring 45 is formed using an electrolytic plating technique such as that above, it is possible to form the penetration wiring 45 without forming an adhesive layer in the inner portion of the penetration hole 44. As a result of this, even in a case in which the aspect ratio is high and it is difficult to form the adhesive layer inside the penetration hole 44, it is possible to form the penetration wiring 45 stably.

As is also disclosed in JP-A-2011-111996, it is it is difficult to form an adhesive layer having a high coverage (covering) ratio in a case in which the aspect ratio is 3 or more in a penetration hole of the related art. As a result of this, it is not possible to ensure an adhesive force even if the penetration wiring is formed inside the penetration hole using an electrolytic plating technique, and there is a concern that the penetration wiring will stick out to the outer side from the penetration hole when heat, an external force, or the like is applied to a sealing plate. Therefore, it is preferable that the invention is adopted in a case in which penetration wiring is formed in a penetration hole in which the aspect ratio L/D is 3 or more. In addition, it is preferable that the penetration wiring 45 is formed using the above-mentioned electrolytic plating technique in which an adhesive layer is not formed, in a case in which an aspect ratio L'/D' of the connection wiring 67 (L' is the length of the connection wiring 67 and D' is the opening diameter of the connection wiring 67: refer to FIG. 4) is 3 or more.

Furthermore, even supposing it is possible to form an adhesive layer inside a penetration hole, in a case in which the conductor is grown inside a penetration hole having a high aspect ratio L/D, there is a concern that a void will be generated within the penetration wiring. However, in the present embodiment, since the penetration wiring 45 is formed in an inner portion of the penetration hole 44 using an electrolytic plating technique in which an adhesive layer is not formed, it is possible to suppress the generation of such a void. In addition, even if formed using such a method, since the cross-sectional area of the penetration wiring 45 is configured to increase from midway in the plate thickness direction of the sealing plate 33 toward the first surface 35 and the second surface 36, it is possible to stably fix the penetration wiring 45 inside the penetration hole 44.

Figure 9:
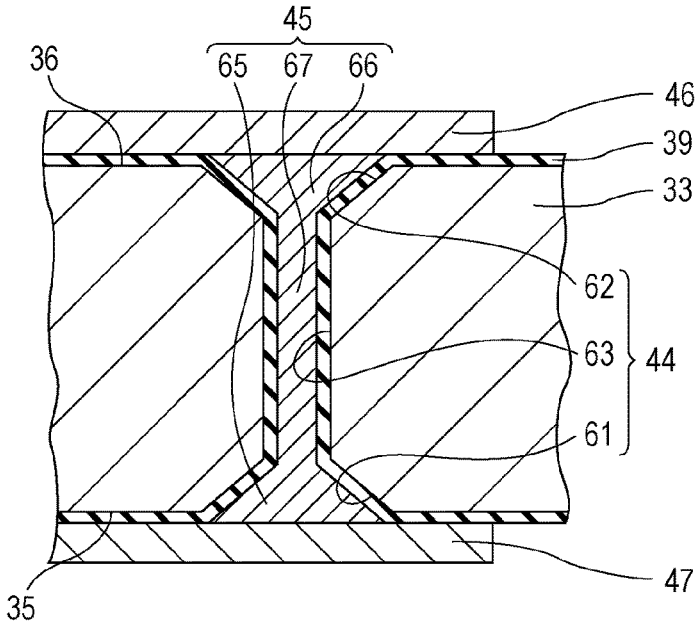
FIG. 9 is a cross-sectional view in which main parts of a sealing plate in a second embodiment are enlarged.

Incidentally, the shapes of the penetration hole 44 and the penetration wiring 45 are is not limited to those of the above-mentioned first embodiment. The penetration hole 44 and the penetration wiring 45 may have any shape as long as the cross-sectional areas of penetration hole 44 and the penetration wiring 45 on the surface that is parallel to the first surface 35 increases from midway in the plate thickness direction of the sealing plate 33 toward the first surface 35 and the second surface 36. For example, in a second embodiment that is shown in FIG. 9, both end portions (respective portions of predetermined ranges in the plate thickness direction from the first surface 35 and the second surface 36) of the penetration hole 44 are configured to gradually increase in diameter toward the first surface 35 and the second surface 36. In other words, the cross-sectional areas of penetration hole 44 and the penetration wiring 45 on the surface that is parallel to the first surface 35 is continuously enlarged from midway in the plate thickness direction of the sealing plate 33 toward the first surface 35 and the second surface 36.

As shown in FIG. 9, in the same manner as the first embodiment, the penetration channel 63 in the present embodiment is an oblong hole that links the first recessed portion 61 and the second recessed portion 62. In addition, in the present embodiment, the opening area of the first recessed portion 61 on the first surface 35 side, and the opening area of the second recessed portion 62 on the second surface 36 side, are formed to be larger than the cross-sectional area of the penetration channel 63 in the same manner as the first embodiment. Further, the first recessed portion 61 is configured to gradually decrease in diameter toward the penetration channel 63 from the opening on the first surface 35 side. In other words, the cross-sectional area of the first recessed portion 61 on the surface that is parallel to the first surface 35 gradually increases toward the first surface 35 from the penetration channel 63. That is, the side walls of the first recessed portion 61 are inclined toward an opening edge of the penetration channel 63 on the first recessed portion 61 side from an opening edge on the first surface 35 side. Further, as a result of this, the cross-sectional area of the first end portion 65, with which the first recessed portion 61 is filled, on the surface that is parallel to the first surface 35, also gradually increases toward the first surface 35 from the connection wiring 67, with which the penetration channel 63 is filled. In the same manner, the second recessed portion 62 is configured to gradually decrease in diameter toward the penetration channel 63 from the opening on the second surface 36 side. In other words, the cross-sectional area of the second recessed portion 62 on the surface that is parallel to the first surface 35 gradually increases toward the second surface 36 from the penetration channel 63. That is, the side walls of the second recessed portion 62 are inclined toward an opening edge of the penetration channel 63 on the second recessed portion 62 side from an opening edge on the second surface 36 side. Further, as a result of this, the cross-sectional area of the second end portion 66, with which the second recessed portion 62 is filled, on the surface that is parallel to the first surface 35, also gradually increases toward the second surface 36 from the connection wiring 67. Additionally, since the other configurations are the same as those of the above-mentioned first embodiment, description thereof will be omitted.

As a result of this, in comparison with the first recessed portion 61, the second recessed portion 62, and the like in the first embodiment, it is possible to reduce an angle that is formed on the inner walls of the penetration hole 44. As a result of this, it is possible to reduce a portion in which an electric field, stress, and the like, concentrate, and therefore, it is possible to improve the reliability of the sealing plate 33. Further, since such first recessed portion 61 and the second recessed portion 62 can be created using a wet etching technique that differs from that of the first embodiment, the formation of the penetration wiring 45 is facilitated. A specific manufacturing method of the penetration wiring 45 will be described.

Figure 10:
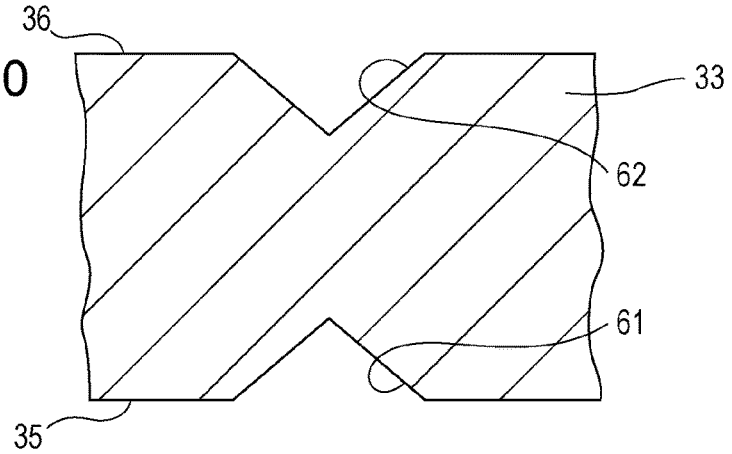
FIG. 10 is a cross-sectional view that describes a manufacturing process of penetration wiring in the second embodiment.

FIG. 10 to FIG. 13 are cross-sectional views that describe a manufacturing process of the penetration wiring 45. Firstly, as shown in FIG. 10, in a first recessed portion formation process, the first recessed portion 61 is formed by removing a portion of the sealing plate 33, which is formed from a monocrystalline silicon substrate, on the first surface 35 up to midway in the plate thickness direction. More specifically, a mask layer, in which a position that corresponds to the first recessed portion 61, and the like, is open, is formed on the first surface 35 of the sealing plate 33 by carrying out an exposure process and a developing process, and thereafter, the first recessed portion 61 is formed by digging through the sealing plate 33 using a wet etching technique. In the present embodiment, since a monocrystalline silicon substrate in which the crystal plane orientation of outer surfaces is set as (110), is dug through using a wet etching technique, as shown in FIG. 10, a first recessed portion 61 that decreases in diameter toward the second surface 36 side, is formed. Once the first recessed portion 61 is formed, the mask layer is removed. Next, in a second recessed portion formation process, the second recessed portion 62 is formed by removing a portion of the sealing plate 33 on the second surface 36 up to midway in the plate thickness direction. That is, in the same manner as the first recessed portion formation process, a mask layer, in which a position of the sealing plate 33 that corresponds to the second recessed portion 62, and the like, is open, is formed on the second surface 36 by carrying out an exposure process and a developing process, and thereafter, the second recessed portion 62 is formed by digging through the sealing plate 33 using a wet etching technique. As a result of this, in the same manner as the first recessed portion 61, a second recessed portion 62 that decreases in diameter toward the first surface 35 side, is formed. Once the second recessed portion 62 is formed, the mask layer is removed. Additionally, either one of the first recessed portion formation process and the second recessed portion formation process may be performed first.

Figure 11:
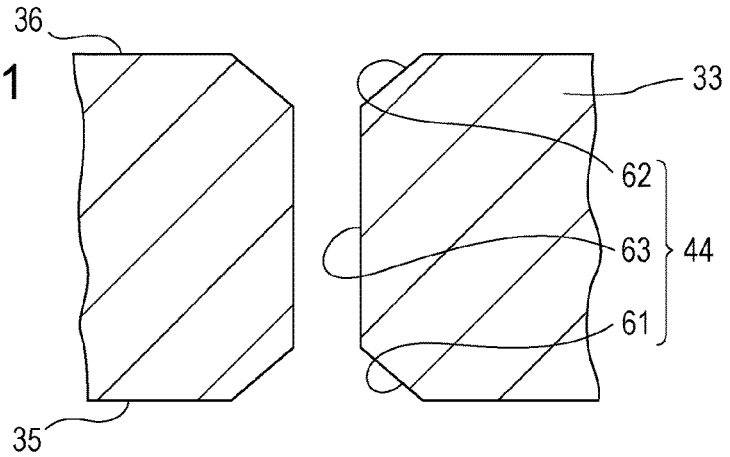
FIG. 11 is a cross-sectional view that describes the manufacturing process of penetration wiring in the second embodiment.
Figure 12:
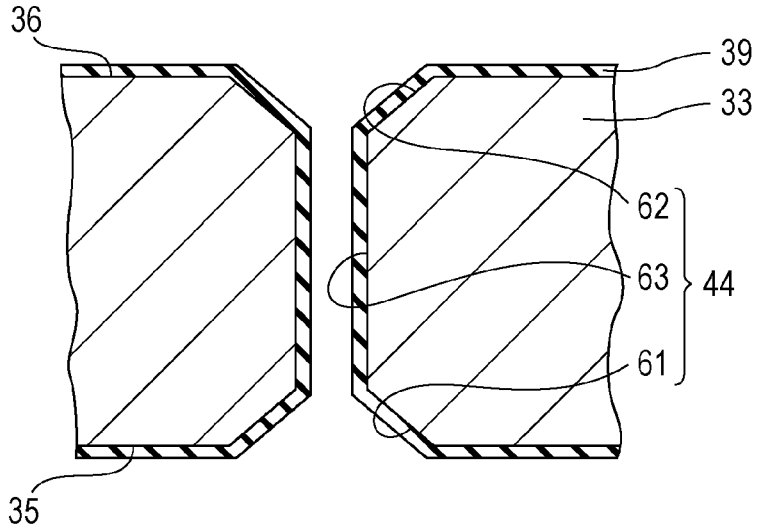
FIG. 12 is a cross-sectional view that describes the manufacturing process of penetration wiring in the second embodiment.
Figure 13:
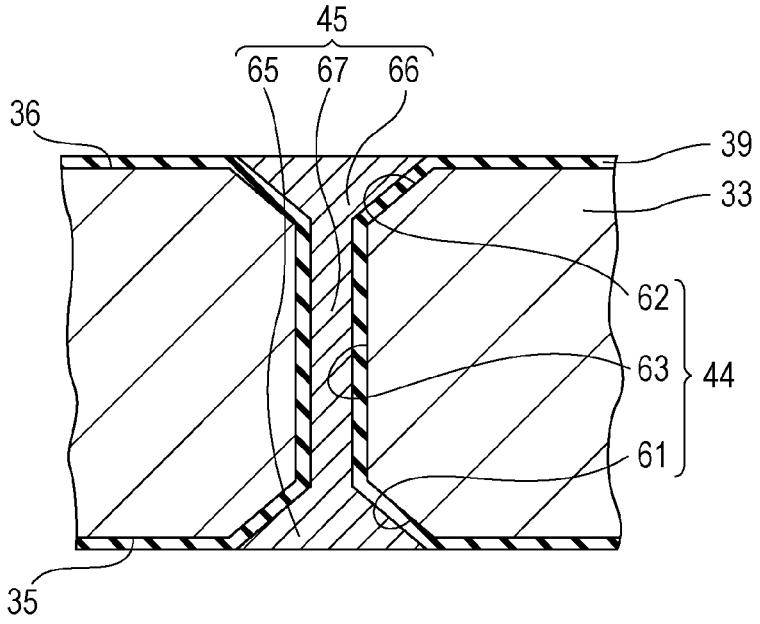
FIG. 13 is a cross-sectional view that describes the manufacturing process of penetration wiring in the second embodiment.

Once the first recessed portion 61 and the second recessed portion 62 are formed in the sealing plate 33, in the same manner as the first embodiment, the penetration channel 63, which penetrates through the first recessed portion 61 and the second recessed portion 62, is formed. In the present embodiment, a penetration channel 63 that penetrates through a central portion (a leading end portion that decreases in diameter) of a bottom portion of the first recessed portion 61, and a central portion (a leading end portion that decreases in diameter) of a bottom portion of the second recessed portion 62, is formed. Additionally, the method of formation of the penetration channel 63 is the same as the first embodiment. As a result of this, as shown in FIG. 11, a penetration channel 63 in which the cross-sectional area (or more specifically, an average value of the cross-sectional areas) on the surface (the surface that is perpendicular to the plate thickness direction) that is parallel to the first surface 35, is smaller than those of the first recessed portion 61 and the second recessed portion 62, is formed. Further, once the penetration hole 44 is formed, as shown in FIG. 12, the insulation film 39 is formed on the inner walls of the first surface 35 and the second surface 36 of the sealing plate 33 and the penetration hole 44. In the present embodiment, the insulation film 39 is also formed by performing a thermal oxidation process. Lastly, as shown in FIG. 13, in the penetration wiring formation process, a conductor (copper (Cu) in the present embodiment), which corresponds to the penetration wiring 45 (that is, the first end portion 65, the second end portion 66 and the connection wiring 67) is formed in the inner portion of the penetration hole 44 (that is, the first recessed portion 61, the second recessed portion 62 and the penetration channel 63) using an electrolytic plating technique. Additionally, since the method that forms the conductor inside the penetration hole 44 using an electrolytic plating technique is the same as that of the above-mentioned first embodiment, description thereof will be omitted.

In this manner, in the present embodiment, since the first recessed portion 61 and the second recessed portion 62 are formed using a wet etching technique, it is possible to form the first recessed portion 61 and the second recessed portion 62 in a short period of time. In addition, since a monocrystalline silicon on which etching proceeds in a direction that is inclined with respect to the first surface 35, is used as the sealing plate 33, it is possible to configure inner walls of the first recessed portion 61 and the second recessed portion 62 as inclined surfaces. As a result of this, it is possible to reduce an angle at which it is easy for an electric field and stress to concentrate.

Additionally, in the above-mentioned first embodiment, in the first recessed portion formation process and the second recessed portion formation process, the first recessed portion 61 and the second recessed portion 62 are formed using a dry etching technique, but the invention is not limited to this configuration. In addition, in the above-mentioned second embodiment, in the first recessed portion formation process and the second recessed portion formation process, the first recessed portion 61 and the second recessed portion 62 are formed using a wet etching technique, but the invention is not limited to this configuration. For example, formation may be performed using a dry etching technique in either one of the first recessed portion formation process or the second recessed portion formation process, and using a wet etching technique in the other process.

In addition, in the above-mentioned first embodiment and second embodiment, only the insulation film 39 is provided between the inner wall of the penetration hole 44 and the penetration wiring 45, which is a conductor, but the invention is not limited to this configuration. For example, a diffusion prevention film, which prevents diffusion of the conductor, may be formed between the penetration wiring 45 and the insulation film 39. For example, the diffusion prevention film is formed using titanium nitride (TiN), or the like. Additionally, in a case in which a diffusion prevention function of the insulation film 39 is sufficient due to the specifications of a product, or the like, in the manner of the present embodiment, a diffusion prevention film need not be provided.

Furthermore, the configuration of the piezoelectric device 14 is not limited to a configuration in which the driving IC 34 is laminated on the sealing plate 33 in the manner of the first embodiment. For example, a configuration in which a driving IC is not laminated on a sealing plate and a direct driving circuit is formed on the outer surface of a sealing plate, may also be used. In other words, it is possible to use a driving IC in which a driving circuit is formed as a sealing plate. In addition to this, a configuration in which a Tape Carrier Package (TCP) in which a driving IC is mounted, is connected to an upper surface of a sealing plate, may also be used.

Further, description is given above using the recording head 3 as an example of a type of liquid ejecting head, but the invention can also be applied to other liquid ejecting heads as long as they are provided with penetration wiring that penetrates through a substrate. For example, it is also possible to apply the invention to color material discharging heads that are used in the manufacturing of color filters such as liquid crystal displays, electrode material discharging heads that are used in electrode formation such as organic Electro Luminescence (EL) displays, Field Emission Displays (FEDs), and the like, and living organic matter discharging heads that are used in the manufacturing of biochips (biochemical elements), and the like.

What is claimed is:

1. A liquid ejecting head comprising:

a first substrate in which a piezoelectric element is provided; and a second substrate on which the first substrate is connected to a first surface, wherein the second substrate is provided with a penetration hole which penetrates through the second substrate, and penetration wiring which is formed from a conductor that is formed in the penetration hole, wherein the penetration wiring is formed from a first end portion, which is provided on a first surface side, a second end portion, which is provided on a second surface side, which is a second surface that is on an opposite side to the first surface, and connection wiring, which connects the first end portion and the second end portion, and wherein a cross-sectional area of the connection wiring in a planar direction of the first surface is smaller than cross-sectional areas of the first end portion and the second end portion in the planar direction.

2. The liquid ejecting head according to claim 1, wherein the cross-sectional area of the first end portion or the second end portion in the planar direction of the first surface gradually increases from the connection wiring toward the first surface or the second surface.

3. The liquid ejecting head according to claim 1, wherein an electrode terminal, which performs electrical connection with the first substrate, is formed on the first surface of the second substrate, and wherein the electrode terminal is formed on an outer surface of a resin that is formed on the first surface.

4. The liquid ejecting head according to claim 1, wherein the penetration wiring is disposed extending in a direction that is perpendicular to the first surface.

5. A manufacturing method of a liquid ejecting head that includes a first substrate in which a piezoelectric element is provided, and a second substrate on which the first substrate is connected to a first surface, the method comprising:

forming a first recessed portion on the first surface of the second substrate;

forming a second recessed portion on a second surface, which is on an opposite side to the first surface, of the second substrate;

forming a penetration channel, a cross-sectional area in the planar direction of the first surface of which is smaller than those of the first recessed portion and the second recessed portion, between the first recessed portion and the second recessed portion, and causing the penetration channel to penetrate through the second substrate; and forming a conductor in each of the first recessed portion, the second recessed portion and the penetration channel using an electrolytic plating technique.

6. The manufacturing method of a liquid ejecting head according to claim 5, wherein at least one of the forming of the first recessed portion and the forming of the second recessed portion includes removing the second substrate using a dry etching technique.

7. The manufacturing method of a liquid ejecting head according to claim 5, wherein at least one of the forming of the first recessed portion and the forming of the second recessed portion includes removing the second substrate using a wet etching technique.

8. The manufacturing method of a liquid ejecting head according to claim 5, wherein the forming of the conductor includes a laser machining technique.

* * * * *